US006643617B1

(12) United States Patent
Wood et al.

(10) Patent No.: US 6,643,617 B1
(45) Date of Patent: Nov. 4, 2003

(54) METHOD TO GENERATE TELEPHONE COMFORT NOISE DURING SILENCE IN A PACKETIZED VOICE COMMUNICATION SYSTEM

(75) Inventors: Robert Geoffrey Wood, Ottawa (CA); Franck Beaucoup, Ottawa (CA)

(73) Assignee: Zarlink Semiconductor Inc. (CA)

( * ) Notice: Subject to any disclaimer, the term of this patent is extended or adjusted under 35 U.S.C. 154(b) by 0 days.

(21) Appl. No.: 09/577,420

(22) Filed: May 22, 2000

(30) Foreign Application Priority Data

May 28, 1999 (GB) ..... 9912574

(51) Int. Cl.[7] ..... G10L 21/02
(52) U.S. Cl. ..... 704/226; 704/228
(58) Field of Search ..... 704/233, 212, 704/220, 200, 226, 227, 228, 201

(56) References Cited

U.S. PATENT DOCUMENTS 5,559,832 A 9/1996 Laird
5,812,965 A * 9/1998 Massaloux ..... 704/205
5,870,397 A * 2/1999 Chauffour et al. ..... 370/435
5,884,268 A 3/1999 Campbell et al.
5,897,613 A * 4/1999 Chan ..... 455/570
5,953,666 A * 9/1999 Lehtimaki ..... 370/328
5,960,389 A * 9/1999 Jarvinen et al. ..... 704/215
5,991,716 A * 11/1999 Lehtimaki ..... 704/212
6,452,941 B1 * 9/2002 Bruhn ..... 370/337
2002/0076034 A1 * 6/2002 Prabhu et al. ..... 379/390.02
2002/0116186 A1 * 8/2002 Strauss et al. ..... 704/233

FOREIGN PATENT DOCUMENTS

EP 1094446 A1 * 4/2001 ..... G10L/19/00

* cited by examiner

*Primary Examiner*—Marsha D. Banks-Harold
*Assistant Examiner*—Angela Armstrong
(74) *Attorney, Agent, or Firm*—Jones Day

(57) ABSTRACT

A method is provided for generating comfort noise in a packetized voice communication system having a transmitter and a receiver. The receiver is provided with a buffer for storing voice packets. The buffer is chosen to be of a predetermine size such that, upon halting the transmitter as a result of silence detection, the buffer is filled with actual silence samples from the transmitter. A comparator compares an output TDM sample pointer with a start of silence pointer of the buffer. In the event that the pointers are the same, silence is flagged and a random number generator loads numbers into the TDM sample pointer for outputting a random sequence of the silence packets to the telephone receiver.

4 Claims, 1 Drawing Sheet

METHOD TO GENERATE TELEPHONE COMFORT NOISE DURING SILENCE IN A PACKETIZED VOICE COMMUNICATION SYSTEM

FIELD OF THE INVENTION

This invention relates in general to packetized voice communication systems, and more particularly to a method of generating comfort noise at a receiver in a packetized voice system during periods of transmitter silence.

BACKGROUND OF THE INVENTION

A packetized voice transmission system comprises a transmitter and a receiver. The transmitter collects voice samples and groups them into packets for transmission across a network to the receiver. The transmitter performs no operations upon the data. The data itself is companded according to u-law or A-law, as defined in ITU-T specification G.711, and is transmitted continuously at a constant TDM data rate (Time Division Multiplexing).

In order to save network bandwidth, packets of samples are only transmitted if voice activity is detected in the packet (i.e. voice data is not transmitted if the packet contains silence). It is known in the art for transmitters to test each packet for silence, prior to transmission, and after a sequence of packets is detected as containing silence, then inhibiting transmission of subsequent silence packets until the next "non-silent" packet is detected. The present invention is not directed at silence detection systems for transmitters, although such systems are disclosed, for example, in U.S. Pat. Nos. 5,276,765; 5,737,695; 4,167,653; 4,277,645 and 5,867,574, and as described in co-pending commonly assigned U.S. application Ser. No. 09/580,788 the contents of which are incorporated herein by reference.

A receiver in a packetized voice system receives packets of voice data from the transmitter and transmits the voice samples at a constant rate to a digital telephone. When transmission has been suppressed as a result of the voice packets containing silence, the receiver circuit must still transmit data to the telephone at the usual rate. However, rather than transmitting pure silence code (e.g. a string of zeroes), it is customary to transmit noise (e.g. white noise or coloured noise) so that a party using the telephone is aware that the communication link with the transmitter is still active.

Two approaches are known in the patent literature for the generation of comfort noise during periods of silence. U.S. Pat. No. 3,614,399 discloses the generation of white, coloured or random noise using simple hardware located at the telephone receiver. U.S. Pat. No. 5,121,349 describes a similar noise generator which includes variable amplitude control. Both prior art approaches generate noise which is not directly related to the transmitter noise.

The second known prior art approach is disclosed in U.S. Pat. No. 5,537,509; 5,630,016; 5,812,965 and 5,809,460, each of which discloses a system for analysing transmitter noise using complex numerical signal processing. When silence, or lack of voice activity, is detected at the transmitter, the silence noise is processed by the transmitter in order to extract parameters which define the amplitude, frequency and time characteristics of the noise. These parameters are then transmitted to the receiver which regenerates the silence noise from these parameters.

SUMMARY OF THE INVENTION

According to the present invention, a method is provided for generating comfort noise at a receiver which is related to the noise characteristics at the transmitter, but does not rely on sophisticated signal processing as set forth in the prior art. More particularly, the packet buffer of the receiver is chosen to be large enough to store a plurality of voice packets but small enough such that, once the transmitter has been halted the buffer is filled with silence code from the transmitter (i.e. the transmitter halts after a predetermined time following detection of silence). The receiver detects the absence of new packets as transmitter silence. A random number generator is used to randomly address locations in the buffer for outputting samples of the transmitter's silence code until the next non-silent voice packet is received.

BRIEF DESCRIPTION OF THE DRAWINGS

A detailed description of a preferred embodiment of the present invention is provided herein below with reference to the sole drawing in which.

DETAILED DESCRIPTION OF THE PREFERRED EMBODIMENT

Figure 1:
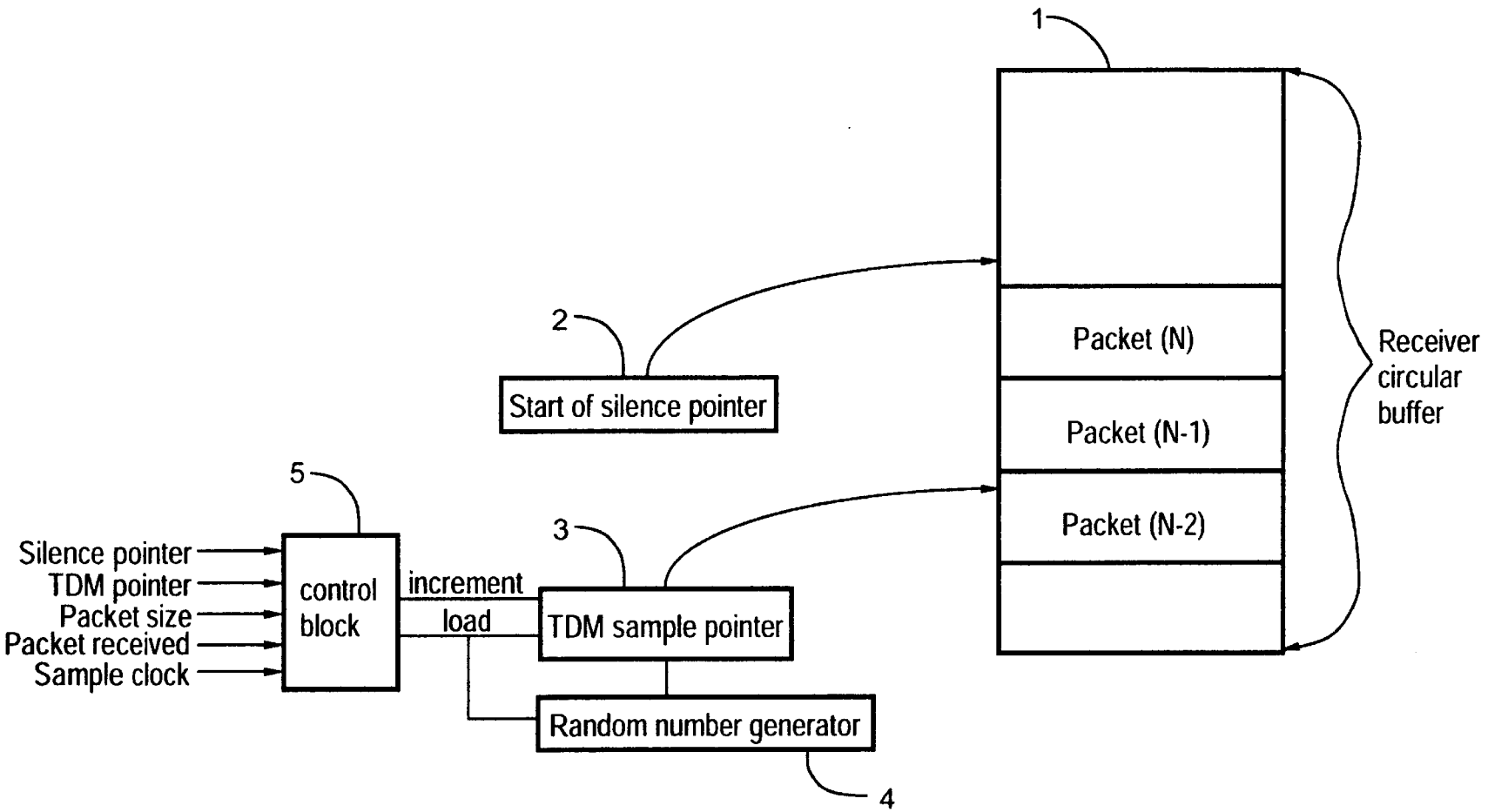
FIG. 1 is a block diagram showing a comfort noise generator for use in a data packet transmission system according to the present invention.

With reference to FIG. 1, a circular buffer (1) is shown in a receiver for storing packets of voice data received from a transmitter and subsequently reading out the voice data at a constant data rate for transmission to a digital telephone (not shown). The packet size may be variable. An example of such a circular buffer is set forth in copending commonly-assigned U.S. application Ser. No. 09/580,788. The buffer is large enough to contain several packets of voice data (e.g. typically of sufficient size to store approximately 0.5 seconds of voice). In any event, the size of the circular buffer (1) must be smaller than the length of time the transmitter requires to halt the transmission of silence packets. This ensures that when packet transmission is ceased due to silence being detected, the circular buffer (1) is fully stored with silence data from the transmitter (i.e. silence data transmitted before the transmitter was halted as a result of operation of the silence detector).

Data packets containing voice samples are written into the circular buffer (1) as they are received. The location in the buffer to which the packet is to be written is indicated by a pointer (2), referred to as the "start of silence" pointer. As each packet, N−2, N−1, N, is received and written, sample by sample, to the buffer (1), the start of silence pointer (2) is incremented by the received packet size. Thus, after the reception of a packet, the start of silence pointer (2) points to the next available location in the buffer (1) for receiving the next packet.

TDM data is read out of the buffer (1), sample by sample, from the location pointed to by the TDM sample pointer (3). This pointer is incremented after each sample is read. The method by which packets are written to the buffer (1) and TDM voice samples are read from the buffer does not form part of the present invention. However, a preferred method is set forth in co-pending commonly-assigned U.S. application Ser. No. 09/580,788 referred to herein above.

According to the present invention, a control block (5) is provided for, inter alia, continuously comparing the TDM pointer (3) with the start of silence pointer (2). When the TDM pointer equals the start of silence pointer, a state of silence is indicated and flagged. This state of silence continues until the reception of another packet of data. During this state of silence, data samples must still be read out from the buffer (1), as discussed above. However, once silence has been detected at the transmitter, the transmitter halts generation of voice data.

According to one approach, the contents of buffer (1) may be read out repeatedly and sequentially, since the buffer contains voice data which corresponds to the last transmission of actual silence by the transmitter. However, this is considered to be undesirable since unacceptable distortion may develop in the receiver. Specifically, any background click or noise spike in the transmitter's silence code will become repetitive and very noticeable.

Thus, according to the present invention, when a state of silence is detected, the TDM sample pointer (3) is loaded with a random number, generated by a pseudo-random number generator (4). The TDM pointer (3) is incremented after each TDM sample is output to the receiver. This continues for a predefined total number of samples in a packet, at which point the random number generator (4) loads a new random number into the TDM pointer (3) and a further packet of silence samples is read out of the buffer (1). All addresses to the buffer (1), whether the start of silence pointer (2) or TDM sample pointer (3), are formed by concatenating a start address which provides the most significant bits of the buffer address with the appropriate one of the start of silence pointer (2), TDM sample pointer (3) or random number generator (4). There is no carry output from the pointers to the start address as the pointers are incremented, so that when a given one of the pointers or random number generator wraps over its maximum value the start address of the buffer is accessed (i.e. circular buffer operation). The sequence and operation of the foregoing procedure is controlled by the control block (5).

The pseudo-random number generator of the preferred embodiment provides a pattern repetition over 465 packets. Other random number generators can be used without changing operation of the comfort noise generator according to the present invention.

The control block (5) contains a comparator function to compare the start of silence pointer (2) with the TDM sample pointer (3); a counter function to count the number of samples transmitted and a controlling state machine which is driven by the sample clock. The function of the control block (5) is represented by the verilog language hardware description set forth below. The logic to enforce circular buffer operation is not set forth, but operates to mask the start of silence (2) and TDM sample (3) pointers and concatenates them with a buffer start address, as set forth above.

```
reg [7:0] sample_count;      //sample counter
reg [12:0] SOS;              //start of silence pointer
reg [12:0] TOA;              //TDM sample pointer
reg [9:0] rand;              //random number generator
integer N;
parameter SEED = 'b1000000100;      //this defines the random number
generator polynomial
wire reset;
wire sample_clock;
wire [7:0] packet_size;      //size of packets during silence state
wire [7:0] rx_packet_size;   //size of received packet when not in
                               silence state
wire packet_received;
//silence state control
always @(posedge sample_clock)
begin
  if (SOS = TOA & !packet_received) silence_state = 1;
  if (packet_received) silence_state = 0;
end
```

-continued

```
//TDM sample pointer control
always @(posedge sample_clock)
begin
  if (silence_state & !packet_received)
  begin
    if (sample_count == packet_size)
    begin
      sample_count = 0;
      TOA = random_number;
    end
  end
  if (silence_state & packet_received)
  begin
    TOA = 0;                    //re-initialization function
  end
  TOA = TOA + 1;
  sample_count = sample_count + 1;
end
//start of silence pointer control
always @(posedge sample_clock)
begin
  if (!silence_state & packet_received) SOS = SOS +
  rx_packet_size;
                                          //normal mode
  if (silence_state & packet_received) SOS = rx_packet_size;
                                  //re-initialization
  if (!packet_received) SOS = SOS;
        //no operation
end
//random number generator
always @(posedge sample_clock)
begin
  if(reset) rand = ~SEED;
  else
  begin
          for(N =0; N <9; N = N + 1) rand[N] =
          rand[N+1]^SEED[N]^
rand[0];
          rand[9] = rand[0] + 1;
  end
end
```

With respect to the foregoing verilog code, the register sizes are related to a preferred implementation. It will be appreciated by a person of ordinary skill in the art that the register sizes may be varied according to particular application requirements. Also, the size of the received packets, rx_packet_size, in number of samples, need not be constant but can vary arbitrarily. Further, this value need not be related to the packet size used to control the TDM sample pointer (3) reloading from the random number generator (4).

Alternative embodiments and variations of the invention are possible. For example, the quality of comfort noise generated may be improved slightly, at the expense of further complexity, by employing a further random number generator in place of the silence state packet_size, with the magnitude of fluctuation of the packet_size being restricted to a specific range.

All such changes and modifications may be made without departing from the sphere and scope of the invention as defined by the claims appended hereto.

What is claimed is:

1. A method of providing comfort noise in a packetized voice communication system having a transmitter and a receiver, said transmitter being adapted to halt transmission of packets of voice samples after a predetermined time period following detection of silence, and said receiver having a first pointer to a first address in a buffer into which an incoming one of said packets of voice samples is stored and a second pointer to a second address in said buffer from which an outgoing one of said packets of voice samples is retrieved, said buffer being of a size to store a plurality of said packets of voice samples representing a speech duration which is less than said predetermined time period such that said buffer is full of noise samples after said transmitter has been halted, said method comprising the steps of:

continuously comparing said second pointer to said first pointer and, in the event said second address is equal to said first address, then loading said second pointer with a random number and retrieving and outputting from said second address pointed to by said second pointer said outgoing one of said packets of voice samples.

2. A comfort noise generator for use in a packetized voice communication system having a transmitter and a receiver, said transmitter being adapted to halt transmission of packets of voice samples after a predetermined time period following detection of silence, said receiver having a first pointer to a first address in a buffer into which a first sample of an incoming one of said packets of voice samples is stored, successive samples of said incoming one of said packets of voice samples being stored in successive addresses following said first address, said receiver having a second pointer to a second address in said buffer from which a first sample of an outgoing one of said packets of voice samples is retrieved, successive samples of said outgoing one of said packets of voice samples being retrieved from successive addresses following said second address, said buffer being of a size to store a plurality of said packets of voice samples representing a speech duration which is less than said predetermined time period such that said buffer is full of noise samples after said transmitter has been halted, said comfort noise generator comprising:

a control block for continuously comparing said second pointer to said first pointer; and a random number generator for loading said second pointer with a random number in the event said second address is equal to said first address, whereby said outgoing one of said packets of voice samples pointed to by said second pointer is retrieved and output.

3. The comfort noise generator of claim 2, wherein said control block further comprises a comparator for comparing said second pointer to said first pointer, a counter for incrementing said first pointer and said second pointer for storing and retrieving, respectively, successive ones of said samples of each packet, and a state machine for controlling operation of said second pointer and said random number generator.

4. The comfort noise generator of claim 3, wherein said control block and random number generator are implemented via verilog code as follows:

```
reg [7:0] sample_count;      //sample counter
reg [12:0] SOS;              //start of silence pointer
reg [12:0] TOA;              //TDM sample pointer
```

-continued

```
reg [9:0] rand;                    //random number generator
integer N;
parameter SEED = 'b1000000100;     //this defines the random number
generator polynomial
wire reset;
wire sample_clock;
wire [7:0] packet_size;            //size of packets during silence state
wire [7:0] rx_packet_size;         //size of received packet when not in
                                    silence state
wire packet_received;
//silence state control
always @(posedge sample_clock)
begin
  if (SOS = TOA & !packet_received) silence_state = 1;
  if (packet_received) silence_state = 0;
end
//TDM sample pointer control
always @(posedge sample_clock)
begin
  if (silence_state & !packet_received)
  begin
    if (sample_count == packet_size)
    begin
      sample_count = 0;
      TOA = random_number;
    end
  end
  if (silence_state & packet_received)
  begin
    TOA = 0;                       //re-initialization function
  end
  TOA = TOA + 1;
  sample_count = sample_count + 1;
end
//start of silence pointer control
always @(posedge sample_clock)
begin
  if (!silence_state & packet_received) SOS = SOS +
  rx_packet_size;
                                                  //normal mode
  if (silence_state & packet_received) SOS = rx_packet_size;
                                    //re-initialization
  if (!packet_received) SOS = SOS;
        //no operation
end
//random number generator
always @(posedge sample_clock)
begin
  if (reset) rand = ~SEED;
  else
  begin
          for (N =0; N <9; N = N + 1) rand[N] =
          rand[N +1] ^SEED[N]^
rand[0];
          rand[9] = rand[0] + 1;
  end
end.
```

* * * * *